US009970233B2

(12) United States Patent
Hsu et al.

(10) Patent No.: US 9,970,233 B2
(45) Date of Patent: May 15, 2018

(54) CORDLESS CURTAIN ASSEMBLY WITH MAGNETS

(71) Applicant: CHING FENG HOME FASHIONS CO., LTD, Fuxing Shiang, Changhua County (TW)

(72) Inventors: Sheng-Ying Hsu, Fuxing Shiang (TW); Chun Jan Hsu, Fuxing Shiang (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 0 days. days.

(21) Appl. No.: 15/237,632

(22) Filed: Aug. 16, 2016

(65) Prior Publication Data

US 2017/0218693 A1 Aug. 3, 2017

(30) Foreign Application Priority Data

Jan. 29, 2016 (TW) ..... 105201378 U

(51) Int. Cl.
*E06B 9/262* (2006.01)
*E06B 9/24* (2006.01)

(52) U.S. Cl.
CPC ..... *E06B 9/262* (2013.01); *E06B 2009/2405* (2013.01); *E06B 2009/2435* (2013.01); *E06B 2009/2622* (2013.01)

(58) Field of Classification Search
CPC ..... E06B 9/262; E06B 2009/2405; E06B 2009/2423; E06B 2009/2452; E06B 2009/2622
See application file for complete search history.

(56) References Cited

U.S. PATENT DOCUMENTS 4,397,346 A * 8/1983 Chumbley ..... E06B 9/24 160/84.01
6,792,994 B2 * 9/2004 Lin ..... E06B 9/262 160/84.03
7,150,304 B2 12/2006 Hsu
8,905,114 B1 * 12/2014 Whitaker ..... E06B 9/262 160/348
9,677,328 B2 * 6/2017 Hsu ..... E06B 9/262
2006/0021712 A1 * 2/2006 Hsu ..... A47H 23/01 160/84.01
2012/0102707 A1 * 5/2012 Chen ..... E06B 9/262 29/428

(Continued)

OTHER PUBLICATIONS

U.S. Appl. No. 15/091,590, filed Apr. 6, 2016.
U.S. Appl. No. 15/091,593, filed Apr. 6, 2016.

*Primary Examiner* — Blair M Johnson
(74) *Attorney, Agent, or Firm* — Che-Yang Chen; Law Offices of Scott Warmuth

(57) ABSTRACT

A curtain assembly includes a first curtain unit, a second curtain unit and a third curtain unit which includes multiple curtain pieces and each curtain piece includes an inside and an outside. Multiple first magnets are connected to the lower portion of the inside of each curtain piece, and multiple second magnets are connected to the top portion of the outside of each curtain piece. The second curtain unit is connected to the third curtain unit, and third curtain unit is connected to the first curtain unit. The multiple curtain pieces are able to be individually folded to introduce outside light into the room via the folded curtain pieces.

4 Claims, 8 Drawing Sheets

(56) References Cited

U.S. PATENT DOCUMENTS

| | | | | |
|---|---|---|---|---|
| 2012/0234502 | A1* | 9/2012 | Chen | E06B 9/262 160/84.01 |
| 2016/0120352 | A1* | 5/2016 | Hsu | E06B 9/262 160/201 |
| 2016/0376836 | A1* | 12/2016 | Cheng | E06B 9/24 160/89 |
| 2016/0376838 | A1* | 12/2016 | Hsu | E06B 9/28 160/84.03 |

* cited by examiner

CORDLESS CURTAIN ASSEMBLY WITH MAGNETS

BACKGROUND OF THE INVENTION

1. Fields of the Invention

The present invention relates to a curtain assembly, and more particularly, to a cordless curtain assembly having three layers of curtain units and being cooperated with magnets.

2. Descriptions of Related Art

The conventional window curtain comprises control cords which extend downward from the top box of the window curtain, and the control cords may be wrapped around limbs of kids who play around the window. U.S. Pat. No. 7,150,304B2 discloses a cordless blind structure which comprises magnets which allow the blind to be folded upward and positioned by attracting the magnets at different positions of the blind. When unfolding the blind, the user simply pulls the bottom bar of the blind to separate the attracted magnets to unfold the blind.

The U.S. Pat. No. 7,150,304B2 only allows the blind to be folded section by section from the bottom of the blind. The area that is not covered by the folded blind introduces outside light into the room. The blind cannot control only a portion of the blind to introduce outside light into the room.

China utility application 201520453555.1 discloses a curtain assembly with two layers of curtain units, wherein the outer layer includes multiple pieces which are individually positioned by multiple magnets. The operation steps are complicated to control the individual pieces to be folded or not.

The present invention intends to provide a curtain assembly to eliminate the shortcomings mentioned above.

SUMMARY OF THE INVENTION

The present invention relates to a curtain assembly and comprises a first curtain unit, a second curtain unit and a third curtain unit. The first curtain unit is a light-transmittable curtain unit and connected to a top box. Multiple first connection members are connected along two sides of the inside of the first curtain unit. The second curtain unit is a light-transmittable curtain unit and has multiple second connection members connected to the inside of the second curtain unit. The third curtain unit has multiple curtain pieces, and each curtain piece has an inside and an outside. Multiple third connection members are connected to two sides of the top portion the outside of each curtain piece. A path is defined transversely through the lower end of each curtain piece and a rod extends through the path. A fourth connection member is connected to the middle portion of the path and located on the outside of each curtain piece. Multiple first magnets are located in the path of each curtain piece. Multiple second magnets are connected to the outside of each curtain piece. The fourth connection member of each curtain piece is connected to the second connection member of the second curtain unit corresponding thereto. The third connection members of each curtain piece are connected to the first connection members of the first curtain unit corresponding thereto.

Preferably, each of the first, second, third, fourth connection members is a hook-and-loop strip.

Preferably, the path of each of the curtain pieces is formed by folding the lower end of the curtain piece from the inside toward the outside of the curtain piece and being fixed to the outside of the curtain piece by way of heat-pressing.

Preferably, the path of each of the curtain pieces is formed by folding the lower end of the curtain piece from the inside toward the outside of the curtain piece and being fixed to the outside of the curtain piece by way of sewing.

The primary object of the present invention is to provide a curtain assembly which provides multiple curtain pieces which can be individually folded to introduce outside light into the room.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
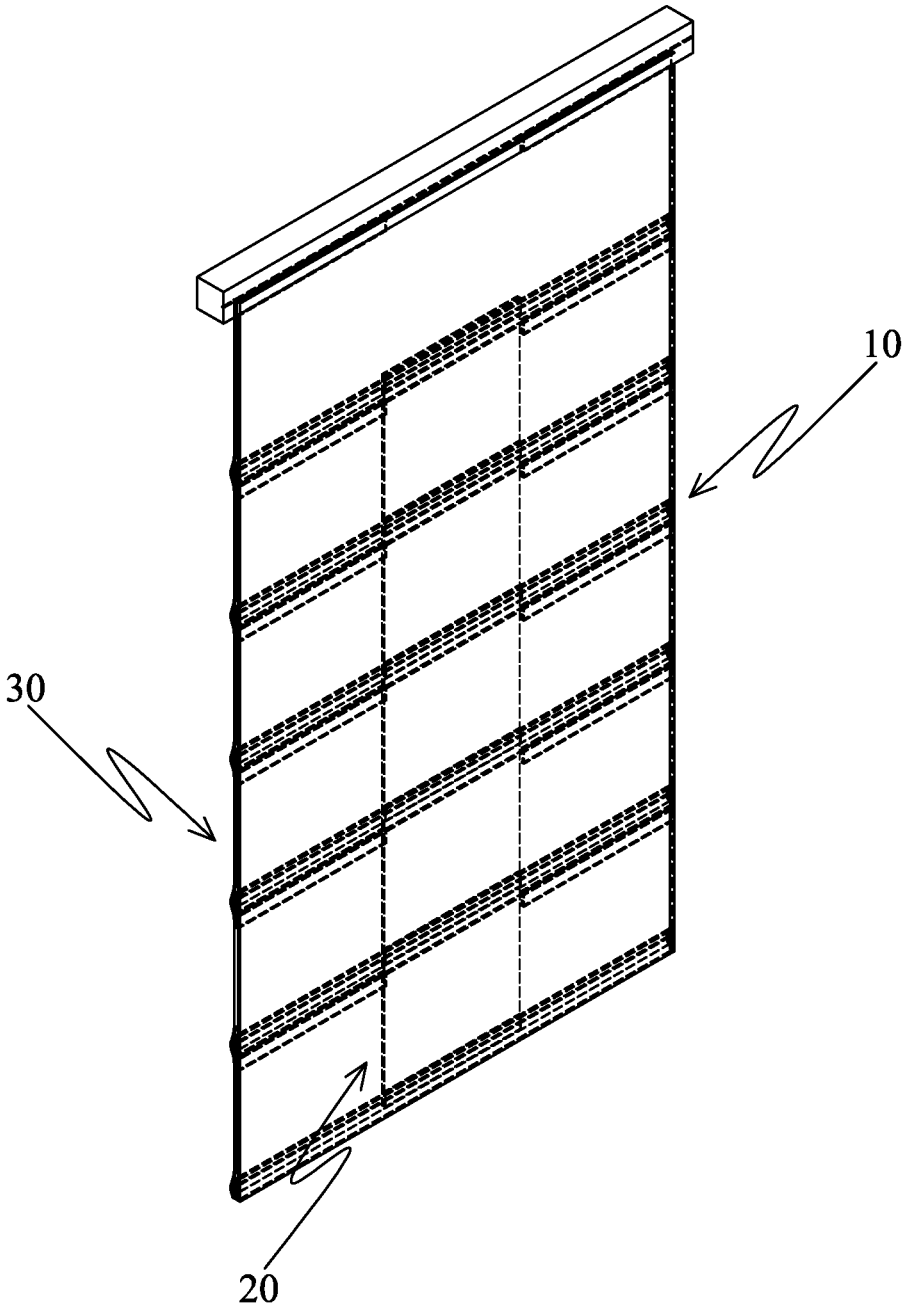
FIG. 1 is a perspective view to show the curtain assembly of the present invention.
Figure 2:
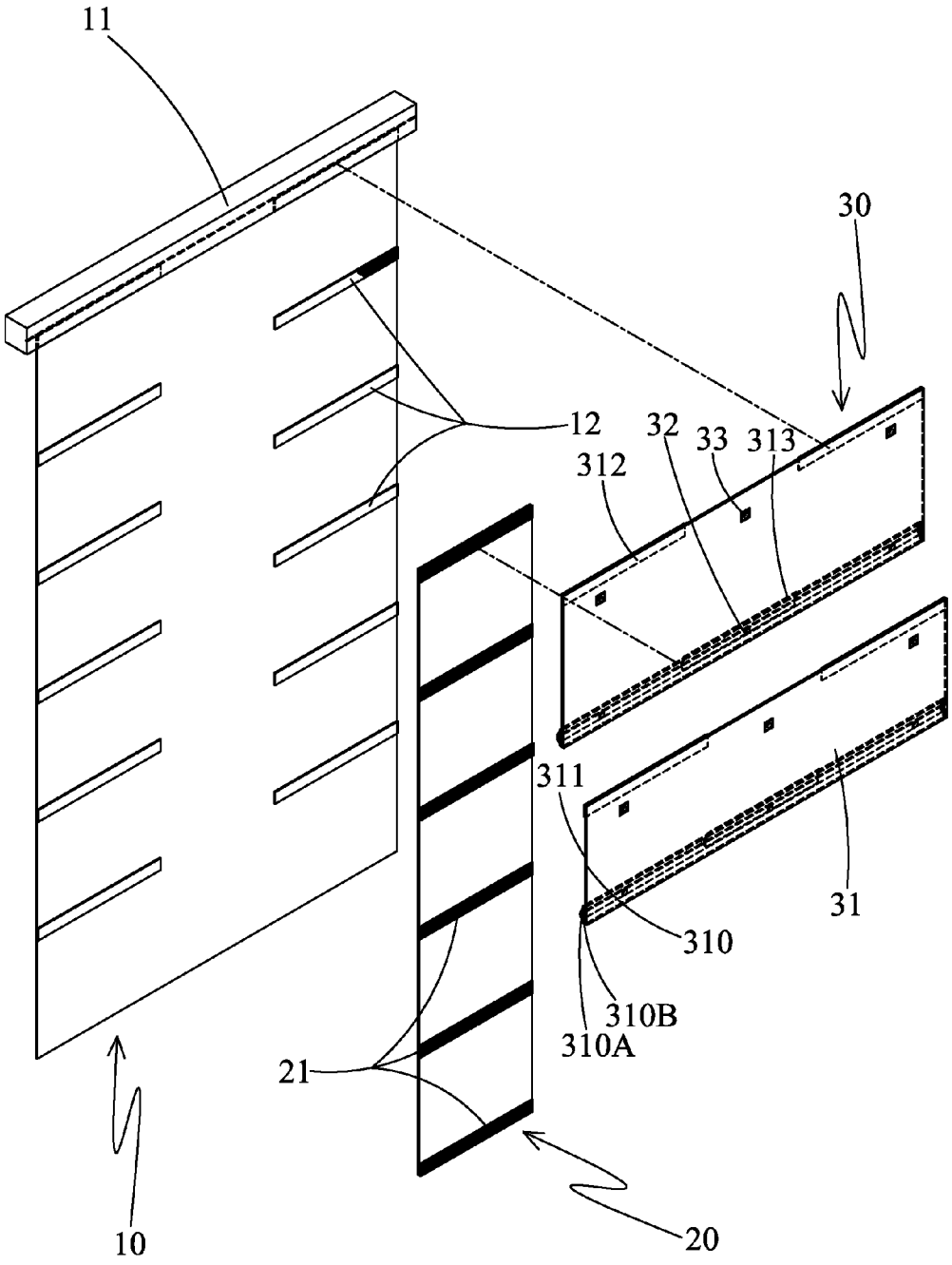
FIG. 2 is an exploded view of the curtain assembly of the present invention.
Figure 3:
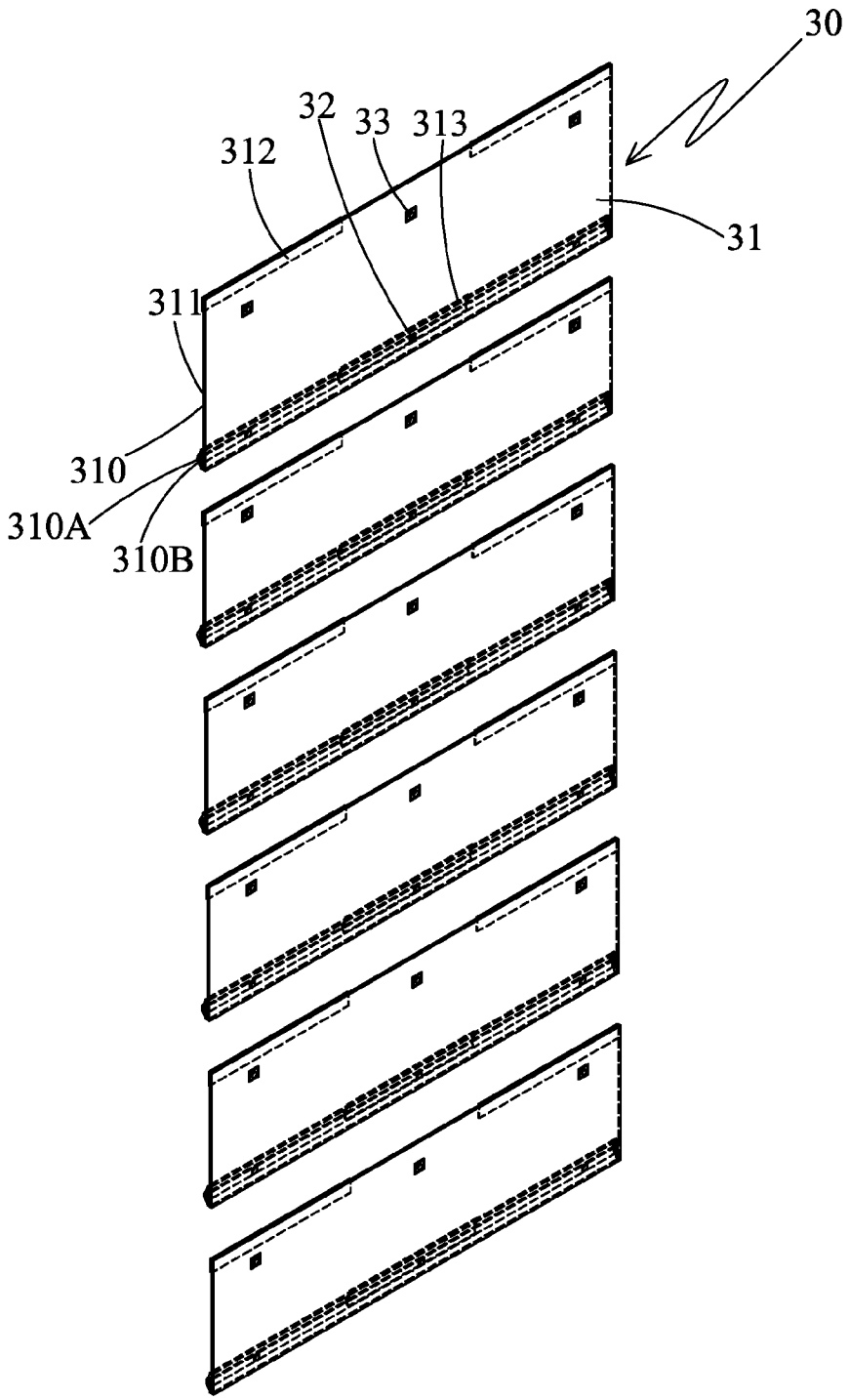
FIG. 3 is an exploded view of the third curtain unit of the curtain assembly of the present invention.
Figure 4:
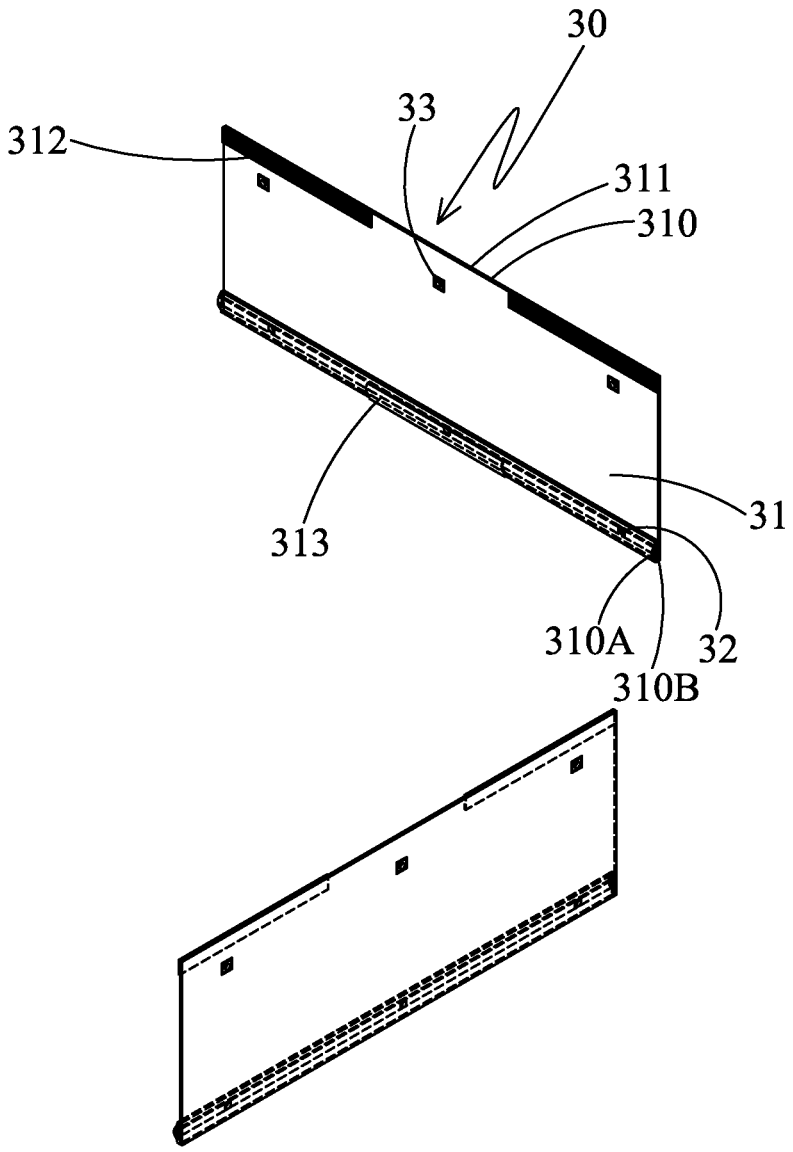
FIG. 4 shows the inside and the outside of each curtain piece of the third curtain unit of the curtain assembly of the present invention.
Figure 5:
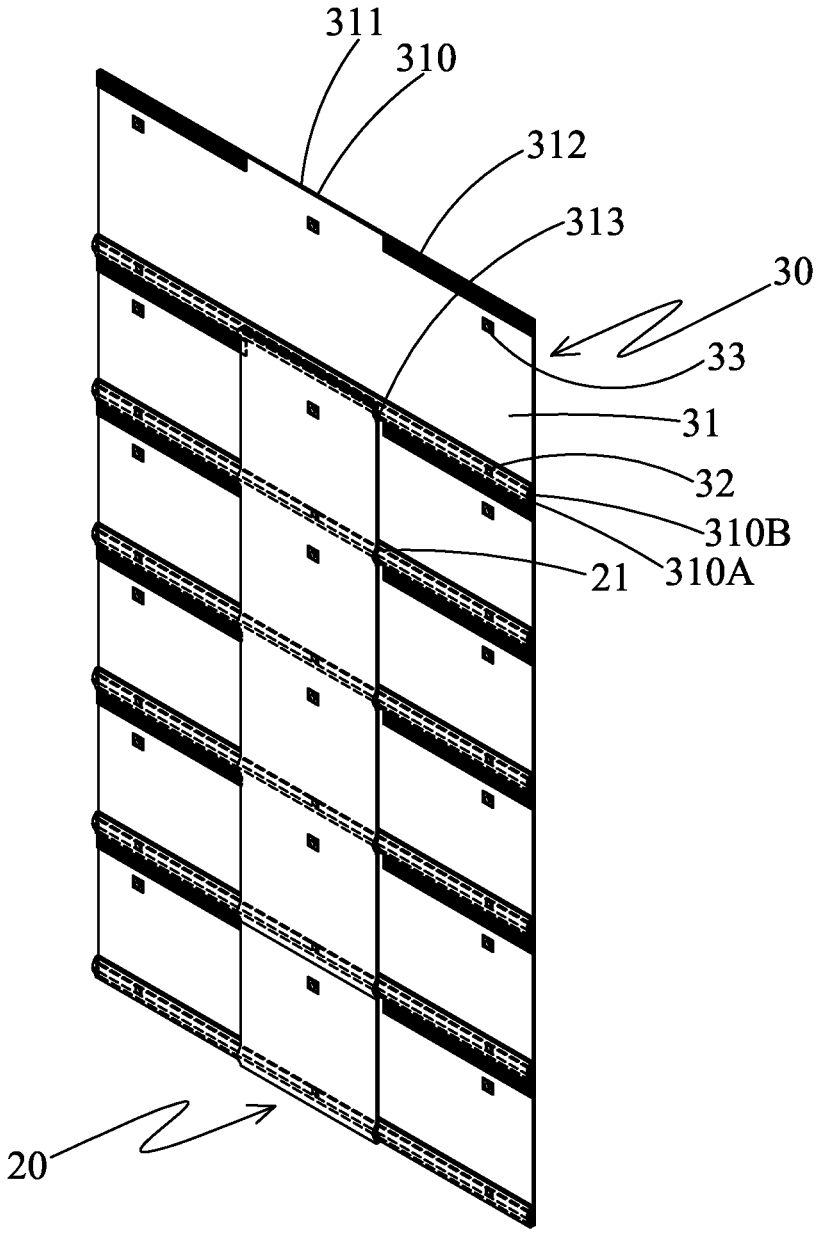
FIG. 5 is a perspective view to show the combination of the second curtain unit and the third curtain unit of the present invention.

Referring to FIGS. 1 to 5, the curtain assembly of the present invention comprises a curtain assembly and comprises a first curtain unit 10 having a top end connected to a top box 11. The first curtain unit 10 is a light-transmittable curtain unit and has an inside and an outside which faces the window for example. Multiple first connection members 12 are connected to two sides of the inside of the first curtain unit 10.

A second curtain unit 20 is a light-transmittable curtain unit and has an inside and an outside which faces the first curtain unit 10. Multiple second connection members 21 are connected to the inside of the second curtain unit 20. The second curtain unit 20 is sized to be located between the two rows of the first connection members 12.

A third curtain unit 30 has multiple curtain pieces 31, and each curtain piece 31 has an inside 310 and an outside 311 which faces the first and second curtain units 10, 20. The curtain pieces 31 each are sized to have the same width as the first curtain unit 10, and to be wider than the second curtain unit 20. Multiple third connection members 312 are connected to two sides of the top portion the outside 311 of each curtain piece 31. A path 310A is defined transversely through the lower end of each curtain piece 31, and a rod 310B extends through the path 310A. A fourth connection member 313 is connected to the middle portion of the path 310A and located on the outside 311 of each curtain piece 31. Multiple first magnets 32 are located in the path 310A of each curtain piece 31. Multiple second magnets 33 are connected to the outside 311 of each curtain piece 31. The fourth connection member 313 of each curtain piece 31 is connected to the second connection member 21 of the second curtain unit 20 corresponding thereto. The third connection members 312 of each curtain piece 31 is connected to the first connection members 12 of the first curtain unit 10 corresponding thereto. The curtain pieces 31 do not allow light to pass thererthrough. In this embodiment, each of the first, second, third, fourth connection members 12, 21, 312, 313 is a hook-and-loop strip.

The path 310A of each of the curtain pieces 31 is formed by folding the lower end of the curtain piece 31 from the inside 310 toward the outside 311 of the curtain piece 31 and is fixed to the outside 311 of the curtain piece 31 by way of heat-pressing. Alternatively, the path 310A of each of the curtain pieces 31 is formed by folding the lower end of the curtain piece 31 from the inside 310 toward the outside 311 of the curtain piece 31 and is fixed to the outside 311 of the curtain piece 31 by way of sewing.

Figure 6:
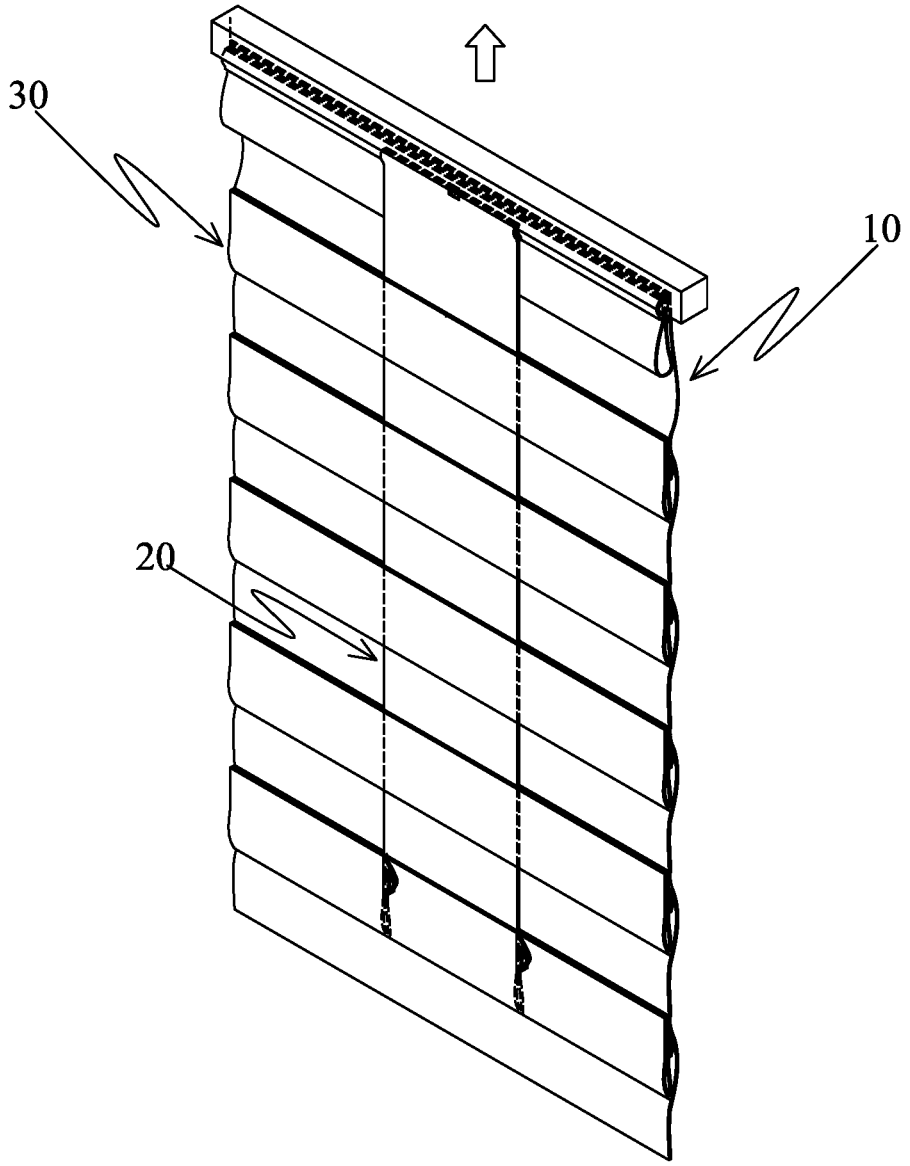
FIG. 6 shows that the curtain pieces are folded upward relative to the first and second curtain units.
Figure 7:
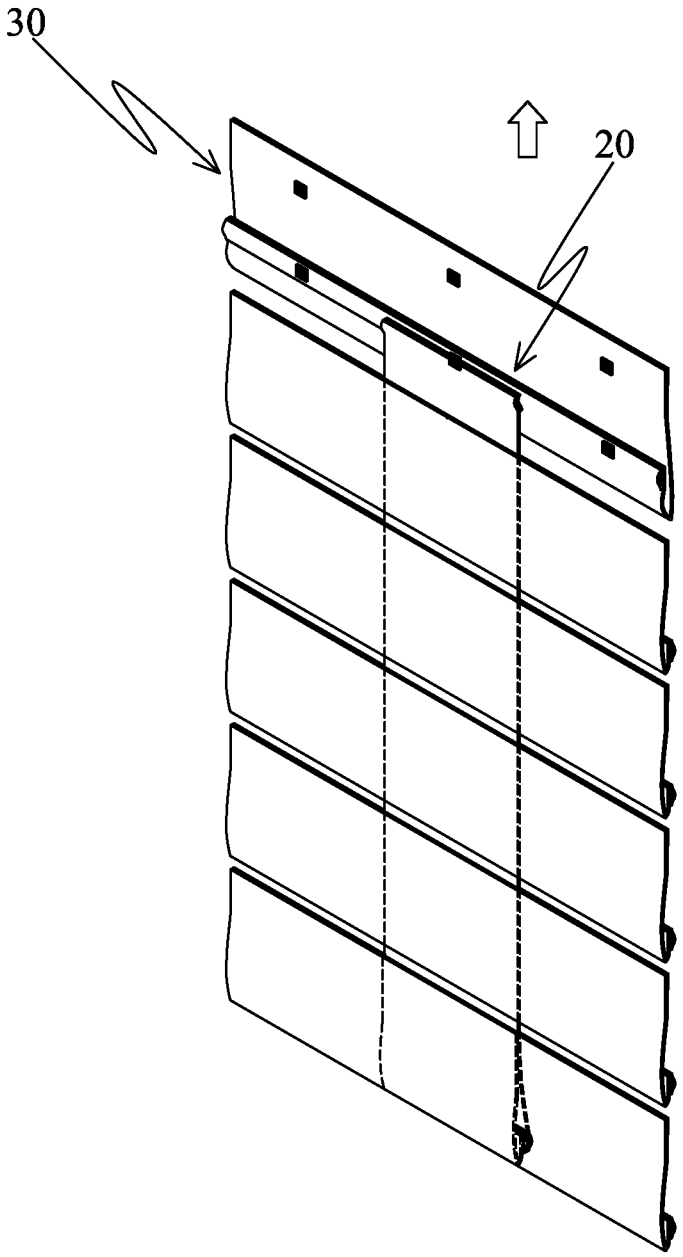
FIG. 7 shows the curtain pieces begin to be folded upward relative to the second curtain unit.
Figure 8:
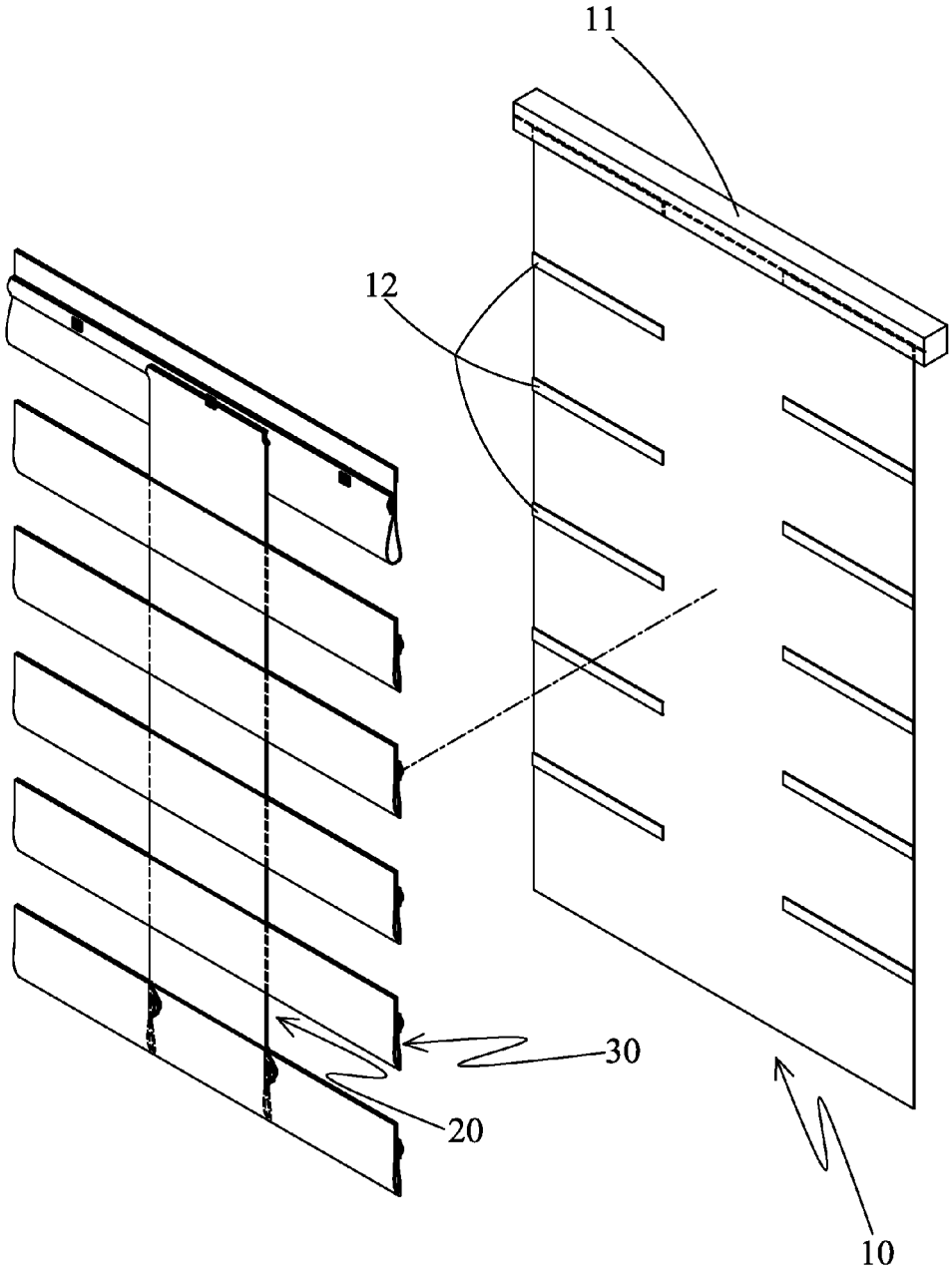
FIG. 8 is an exploded view of first curtain unit and the combination of the second curtain unit and the third curtain unit of the present invention, wherein the curtain pieces are folded upward.

As shown in FIGS. 1 to 8, when in use, the user can individually fold the curtain pieces 31 upward and positioned by attracting the first magnets 32 to the second magnets 33. Therefore, an area is formed when the curtain piece 31 is folded upward, and the outside light is introduced via the area that does not covered by the curtain piece 31 via the first and second curtain units 10, 20. The area that allows the outside light to be introduced into the room can be selectively decided by the user to fold the desired curtain pieces 31.

While we have shown and described the embodiment in accordance with the present invention, it should be clear to those skilled in the art that further embodiments may be made without departing from the scope of the present invention.

What is claimed is:

1. A curtain assembly comprising:

a first curtain unit having a top end connected to a top box, the first curtain unit being a light-transmittable curtain unit and having an inside surface and an outside surface, multiple first connection members connected to two sides of the inside surface of the first curtain unit;

a second curtain unit being a light-transmittable curtain unit and having an inside surface and an outside surface, multiple second connection members connected to the inside surface of the second curtain unit, and a third curtain unit having multiple curtain pieces, each curtain piece having an inside surface and an outside surface, multiple third connection members connected to two sides of a top portion the outside surface of each curtain piece, a path defined transversely through a lower end of each curtain piece and a rod extending through the path, a fourth connection member connected to a middle portion of the path and located on the outside surface of each curtain piece, multiple first magnets located in the path of each curtain piece, multiple second magnets connected to the outside surface of each curtain piece, the fourth connection member of each curtain piece connected to the second connection member of the second curtain unit corresponding thereto, the third connection members of each curtain piece connected to the first connection members of the first curtain unit corresponding thereto.

2. The curtain assembly as claimed in claim 1, wherein each of the first, second, third, fourth connection members is a hook-and-loop strip.

3. The curtain assembly as claimed in claim 1, wherein the path of each of the curtain pieces is formed by folding a lower end of the curtain piece from the inside surface toward the outside surface of the curtain piece and being fixed to the outside surface of the curtain piece by way of heat-pressing.

4. The curtain assembly as claimed in claim 1, wherein the path of each of the curtain pieces is formed by folding a lower end of the curtain piece from the inside surface toward the outside surface of the curtain piece and being fixed to the outside surface of the curtain piece by way of sewing.

* * * * *